US006968140B2

(12) United States Patent
Asai

(10) Patent No.: US 6,968,140 B2
(45) Date of Patent: Nov. 22, 2005

(54) IMAGE FORMING DEVICE

(75) Inventor: Shinji Asai, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 143 days.

(21) Appl. No.: 10/713,002

(22) Filed: Nov. 17, 2003

(65) Prior Publication Data

US 2004/0096237 A1 May 20, 2004

(30) Foreign Application Priority Data

Nov. 18, 2002 (JP) ..... 2002-334185
Sep. 29, 2003 (JP) ..... 2003-338629

(51) Int. Cl.[7] ..... G03G 15/00
(52) U.S. Cl. ..... 399/107; 399/110
(58) Field of Search ..... 399/107, 110, 1; 347/138, 152; D18/36, 39, 41

(56) References Cited

U.S. PATENT DOCUMENTS 5,920,758 A * 7/1999 Ohtsuki ..... 399/107 X
2001/0009619 A1 * 7/2001 Kida ..... 399/107
2001/0010770 A1 * 8/2001 Kominato ..... 399/107 X

FOREIGN PATENT DOCUMENTS

JP 7-219298 8/1995
JP 10-239935 9/1998
JP 2001-042588 A * 2/2001

* cited by examiner

*Primary Examiner*—Sophia S. Chen
(74) *Attorney, Agent, or Firm*—Westerman, Hattori, Daniels & Adrian LLP

(57) ABSTRACT

To provide an image forming device using a generic image recording apparatus and a generic image reading apparatus, which can respond to customer needs. An image recording apparatus is provided inside a supporting table disposed on an upper surface of an image reading apparatus. A control unit is engaged to a rear side of the supporting table to function also as a reinforcing part of the rear side. The control unit can be changed to carry out control processing according to the combination of the image reading apparatus and the image recording apparatus, and the control unit can be replaced as necessary with another control board.

7 Claims, 7 Drawing Sheets

IMAGE FORMING DEVICE

FIELD OF THE INVENTION

The present invention relates to an image forming device such as a copy machine, a facsimile machine, or a multi-function peripheral having a copy function and a facsimile function.

DESCRIPTION OF THE RELATED ART

A conventional digital image forming device converts image information of an original document read by an image reading apparatus into an electric signal, and writes an electrostatic latent image onto a photoconductive drum by an exposing unit of an image recording apparatus in accordance with the electric signal.

In an analog image forming device, light irradiated on an original document reflects directly on a photoconductive drum. Accordingly, in contrast with the conventional analog image forming device, it is not necessary to store the image reading apparatus and the image recording apparatus in one casing in the digital image forming device. As a result, the options in the layout increase. For example, an image reading apparatus and an image recording apparatus may be placed in parallel with one another on a desk, or an image reading apparatus may be placed on a desk and an image recording apparatus may be placed in the space inside the desk.

According to a first conventional image forming device, a toner image forming unit is stored in a first housing having a discharged paper receiving part on an upper part thereof, and an image scanning unit is stored in a second housing that is supported independently of the first housing.

Moreover, according to a second conventional image forming device, the image forming device is stored in a supporting table which supports a peripheral device placed thereon, and a relay connector is attached to the supporting table.

In addition, according to a third conventional image forming device, the image forming device consists of a scanning unit placed on a supporting table and an imaging unit disposed in the supporting table, and the supporting table has supporting legs in which the heights are adjustable.

In the above-described image forming devices, the image reading apparatus and the image recording apparatus are combined. However, the image reading apparatus and the image forming apparatus are made for such a combination. Various types of image reading apparatus and image recording apparatus are made and sold independently of one another. That is, the image reading apparatus and the image recording apparatus are not made for the combination of a specific image reading apparatus and a specific image recording apparatus. In addition, when combining the image reading apparatus and the image recording apparatus to form the image forming device, it is necessary to customize each of the image reading apparatus and the image recording apparatus, and to prepare a device for connecting the image reading apparatus and the image recording apparatus. Once a specific combination is decided, the combination cannot easily be changed based on a request from a customer. As a result, there is the problem that services cannot be given to customers according to their needs.

SUMMARY OF THE INVENTION

An advantage of the present invention is that it provides an image forming device that can facilitate the combination of a generic image recording apparatus and a generic image reading apparatus, and respond appropriately to customer needs.

An image forming device of the present invention includes an image reading apparatus which reads an original document, an image recording apparatus which records onto recording paper, image information read by the image reading apparatus, a control unit which has a control board for controlling the image reading apparatus and the image recording apparatus, and a supporting table. The control unit is attached as part of the supporting table. Furthermore, the control unit is attached as a supporting member disposed on an upper surface of the supporting table. The control unit includes an operation panel. The operation panel is detachably attached to the control unit.

The image reading apparatus is disposed on the supporting table, and the image recording apparatus is disposed inside the supporting table. The image reading apparatus and the image recording apparatus are disposed on the supporting table. A cover, which can be opened upward, is provided on an upper part of the image recording apparatus.

According to the present invention, the image reading apparatus, the image recording apparatus and the control unit having the control board for controlling both apparatuses are made into independent units, and the customization according to the combination of the image reading apparatus and the image recording apparatus can be effected by the control unit. That is, the image reading apparatus and the image recording apparatus are made generic and mass-produced for reducing costs. In addition, the control unit controls signal processing or the like, which becomes necessary when manufacturing an image forming device by combining an image reading apparatus and an image recording apparatus. As a result, it becomes unnecessary to make changes to the image reading apparatus and to the image recording apparatus. Moreover, even when the combination of the image reading apparatus and the image recording apparatus is changed, it is only necessary to change the control unit.

Furthermore, when responding to customer needs, the needs can be addressed using a simple method, i.e., by changing the control board of the control unit. In addition, when performing maintenance, since the image reading apparatus and the image recording apparatus are generic, it becomes easy to identify the problem. In case of a major problem, if a part with the problem is identified as located in either the image recording apparatus or in the image reading apparatus, the problem can be easily addressed by replacing the apparatus having the problem. In case the problem is not located in the apparatuses, the problem can be addressed by the maintenance of the control unit, and the maintenance work can be carried out easily. In this case, the problem can also be solved by replacing the control unit.

In addition, by attaching the control unit itself as part of the supporting table, the number of parts can be reduced, and the entire device can be downsized. In particular, by providing the control unit as a reinforcing part of the rear side of the supporting table, the control unit can be disposed without taking up space, and the strength of the supporting table can be improved. In addition, by providing the control unit on the rear side, the control unit can radiate heat efficiently. Moreover, by attaching the control unit as a supporting part of the upper surface of the supporting table, the supporting strength is increased, the image reading apparatus and the image recording apparatus can be connected easily, and maintenance work can be carried out easily.

As the layout of the image reading apparatus and the image recording apparatus, according to the installation space of the image forming device or according to a request of a user, the image reading apparatus may be provided on the supporting table and the image recording apparatus may be provided in the supporting table, or the image reading apparatus and the image recording apparatus may be placed on the supporting table as appropriate for various installation spaces. Moreover, when adopting an image recording apparatus having a cover, which can be opened upward on an upper part thereof, the layout can be arranged more freely due to such a unitization. As a result, sufficient space can be obtained above the image recording apparatus to allow the cover to be opened and closed.

Further, the image recording apparatus mentioned here includes devices in general that record an image onto paper, and for example, the image recording apparatus is a device which has various recording functions such as a facsimile function, a copy function, and a printer function.

DETAILED DESCRIPTION OF THE PREFERRED EMBODIMENTS

Figure 1:
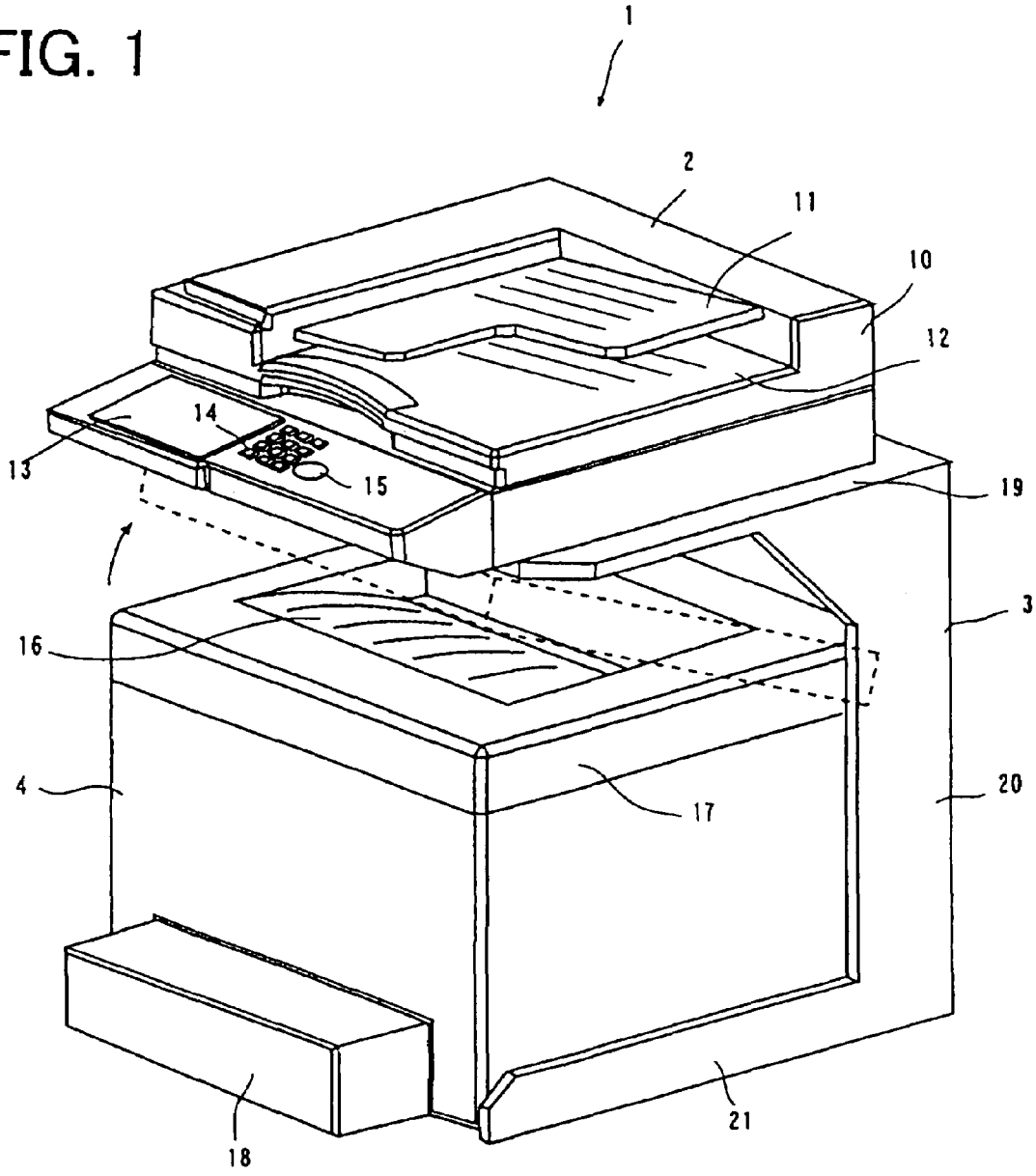
FIG. 1 is a schematic perspective view when viewing an image forming device from the front side according to a first embodiment of the present invention.

Embodiments of the present invention will be described in detail. FIG. 1 is a schematic perspective view when viewing an image forming device from the front side according to a first embodiment of the present invention. An image forming device 1 includes a supporting table 3 formed in a shape of a horseshoe in its side view, an image reading apparatus 2, which is provided on an upper surface of the supporting table 3, and an image recording apparatus 4, which is provided inside the supporting table 3.

An original cover 10 having an automatic document feeder is provided openable and closable in an upper part of the image reading apparatus 2. An original discharge tray 12 is formed uniformly on the original cover 10 by resin, and an original supply tray 11 is disposed above the original discharge tray 12. To the front side of image reading apparatus 2, an operation panel 13 as an operation unit, and operation buttons 14 and 15 for setting a number of sheets or the like are provided. An original document placed on the original supply tray 11 is transported by a transportation roller (not shown), and the transported original document is scanned by a scanning device located below a scanning position. The image information of the scanned original document is converted into an electric signal, and transmitted to a control unit 5 to be described later.

An upper cover 17, which can be opened upward, is provided on an upper part of the image recording apparatus 4. The upper surface of the upper cover 17 functions as a paper discharge tray 16 for stacking the recorded paper. A paper feed cassette 18 is detachably inserted from the front side of the image recording apparatus 4. In accordance with the signal read by the image reading apparatus 2 or in accordance with facsimile image data received through a public communication line or image data transmitted from a remote computer or the like, a signal is output from the control unit 5 to an exposing unit (not shown) inside the image recording apparatus 4. In accordance with the output signal, an electrostatic latent image is formed (written) on a photoconductive drum charged uniformly by the exposing unit of the image recording apparatus 4 side. As shown with dotted lines, the upper cover 17 is attached in a manner such that the upper cover 17 can be opened upward. By opening the upper cover 17 upward, maintenance, such as a removal of a paper jam can be carried out easily.

The supporting table 3 includes a supporting part 19, two supporting columns 20, and supporting legs 21. The supporting part 19 is formed in a tabular shape to support the image reading apparatus 2. The supporting columns 20 are fixed downward from two of four edges of the supporting part 19. The supporting legs 21 extend approximately horizontally from lower ends of the supporting columns 20 respectively. The two supporting legs 21 are connected by a rear frame 23 (refer to FIG. 3).

Figure 2:
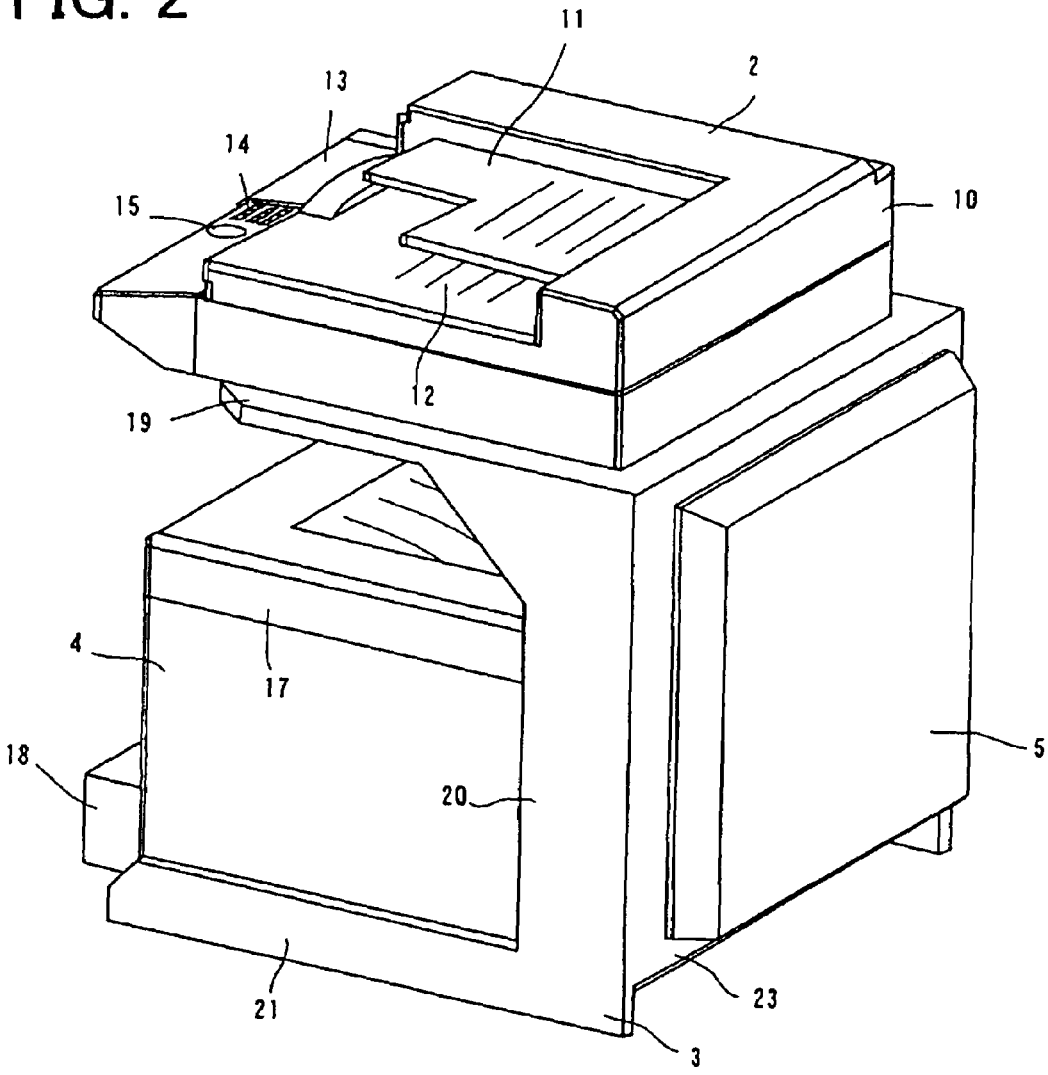
FIG. 2 is a schematic perspective view when viewing the image forming device from the rear side according to the first embodiment.
Figure 3:
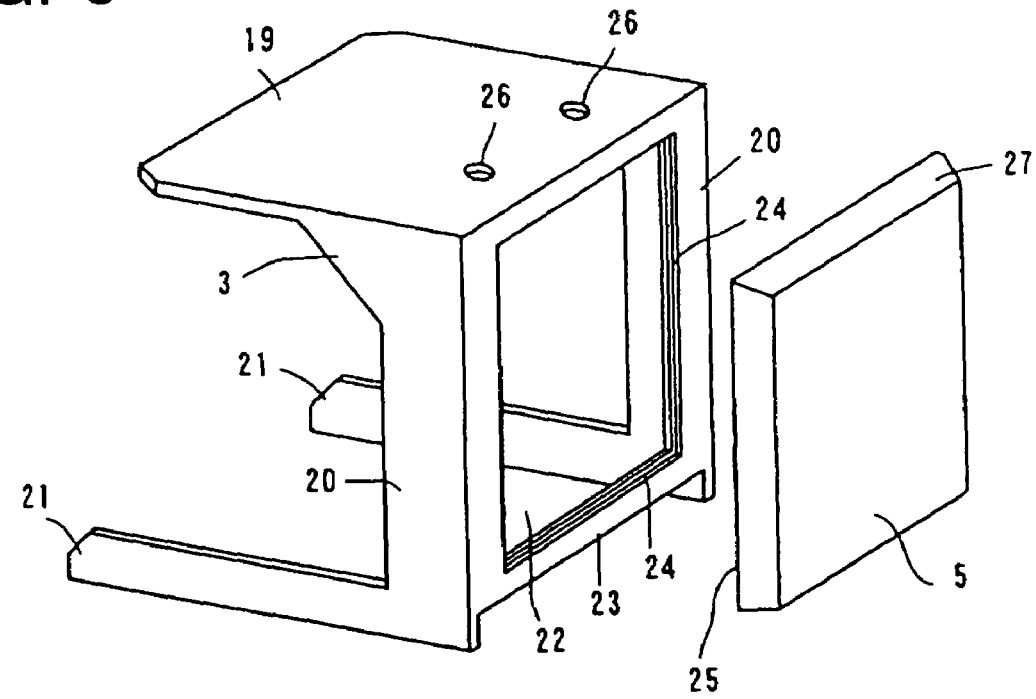
FIG. 3 is an exploded perspective view of a supporting table according to the first embodiment.

FIG. 2 is a schematic perspective view when viewing the image forming device from the rear side according to the first embodiment. The control unit 5 is disposed between the two supporting columns 20 at the rear side of the supporting table 3. As shown in FIG. 3, a rectangular space 22 is formed between the two supporting columns 20. A depressed part 24 is formed on the supporting part 19, the supporting columns 20 and the rear frame 23 surrounding the space 22 so that the control unit 5 can be engaged. The control unit 5 has a rectangular attaching part 25 to be engaged with the depressed part 24. The attaching part 25 is engaged with the depressed part 24 and fixed by a screw or the like. Therefore, the control unit 5 functions as a reinforcing part of the rear side of the supporting table 3 by being fixed to cover the entire surface of the space 22. Holes 26 are drilled through the supporting part 19 for inserting a wire cord to electrically connect the control unit 5 and the image reading apparatus 4.

Figure 4:
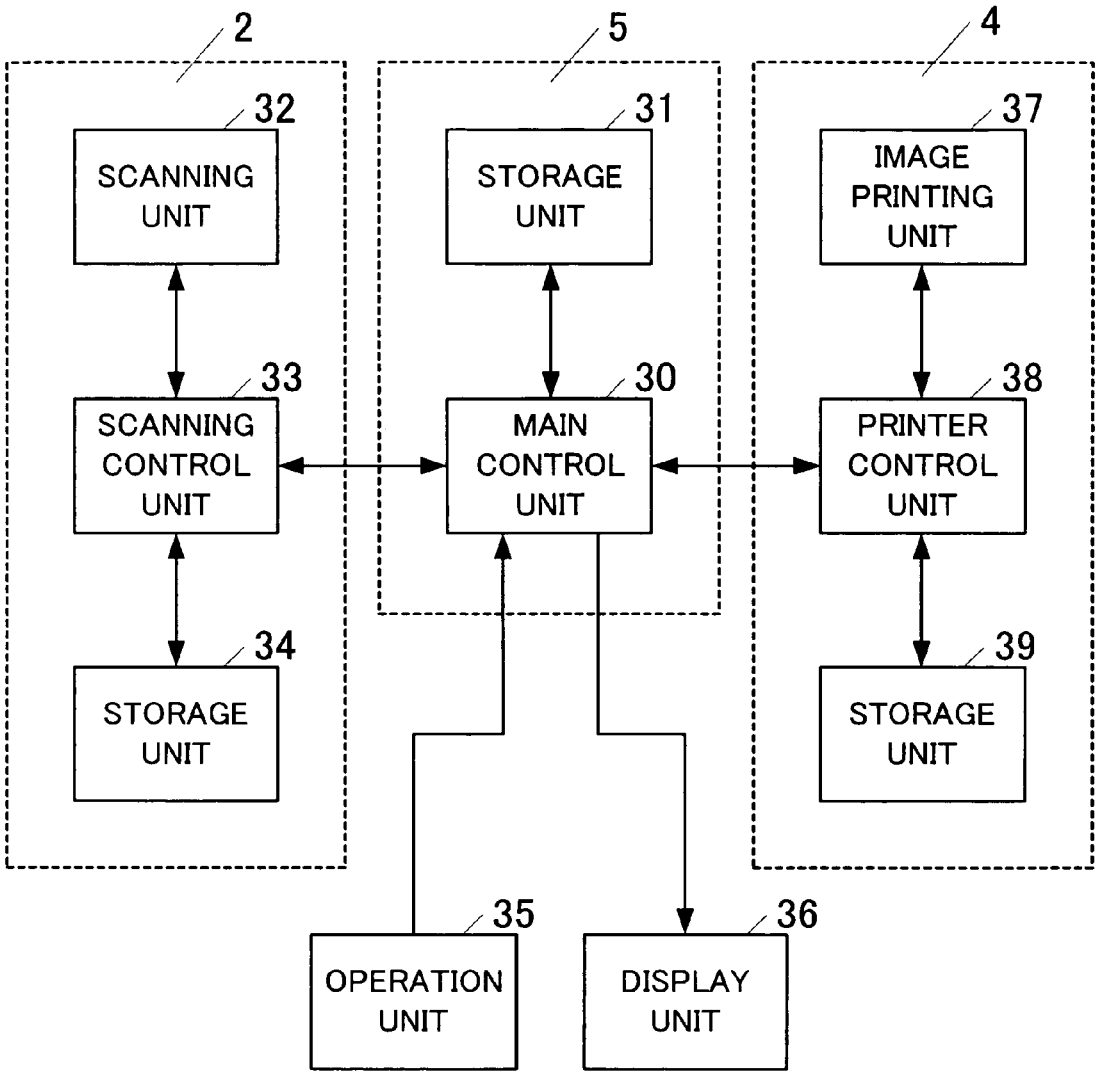
FIG. 4 is a block diagram relating to control according to the first embodiment.

A control board (not shown) is fixed inside an approximately rectangular parallepiped chassis 27 having the attaching part 25. As shown in FIG. 4, the control board consists of a main control unit 30 and a storage unit 31. The main control unit 30 responds to a command signal input from an operation unit 35, fetches a program or the like stored in the storage unit 31, and transmits a control signal to a scanning control unit 33. An image signal, produced by a scanning unit 32 of the image reading apparatus 2, is processed by the scanning control unit 33 and input to the main control unit 30. A storage unit 34 is connected to the scanning control unit 33, and stores programs or the like that are necessary for the scanning process. Processing information or error information is transmitted from the main control unit 30 to a display unit 36 and displayed when necessary. The scanned signal from the scanning control unit 33 is processed by the main control unit 30 and transmitted to a printer control unit 38. The printer control unit 38 fetches information necessary for the printing process that is stored in a storage unit 39, and controls an image printing unit 37 to print out an image onto recording paper. Then, the information relating to the printer processing is transmitted from the printer control unit 38 to the main control unit 30.

The image reading apparatus 2 and the image recording apparatus 4 are controlled via the control unit 5. Therefore, even if the control units of the image reading apparatus 2 and the image recording apparatus 4 are generic, control can flexibly adapt to the combination by carrying out the processes using the main control unit 30 and the storage unit 31. Moreover, by changing the control board of the control unit 5 based on the combination, it can be effected easily. In addition, the main control unit 30 and the storage unit 31 can be configured easily in detail according to customer needs. Since the control unit 5 is formed as a separate body, the maintenance or the like can be performed easily.

Figure 5:
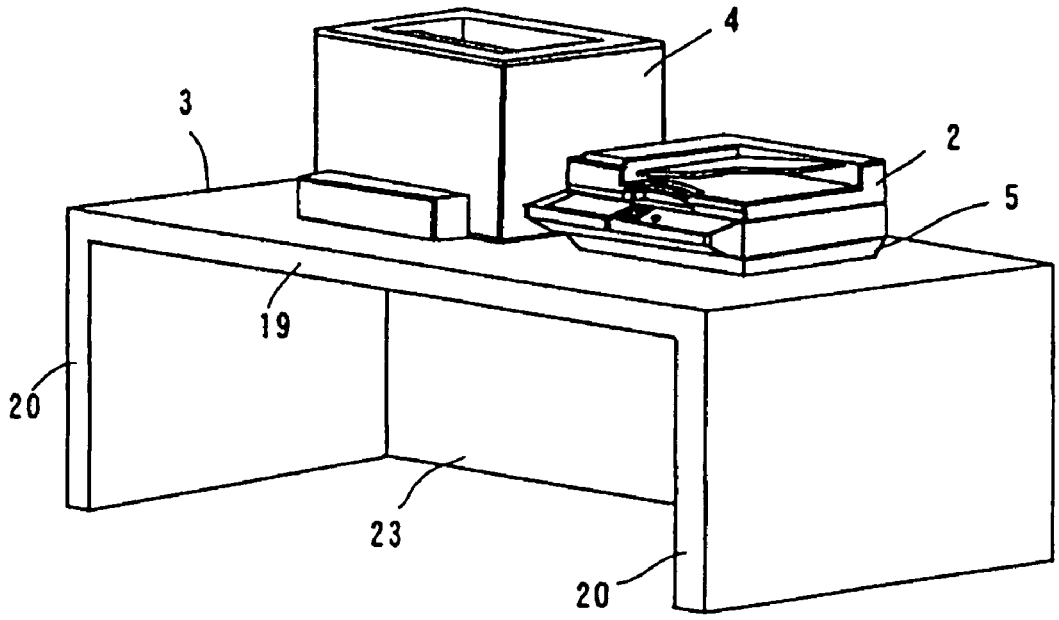
FIG. 5 is a schematic perspective view of an image forming device according to a second embodiment of the present invention.
Figure 6:
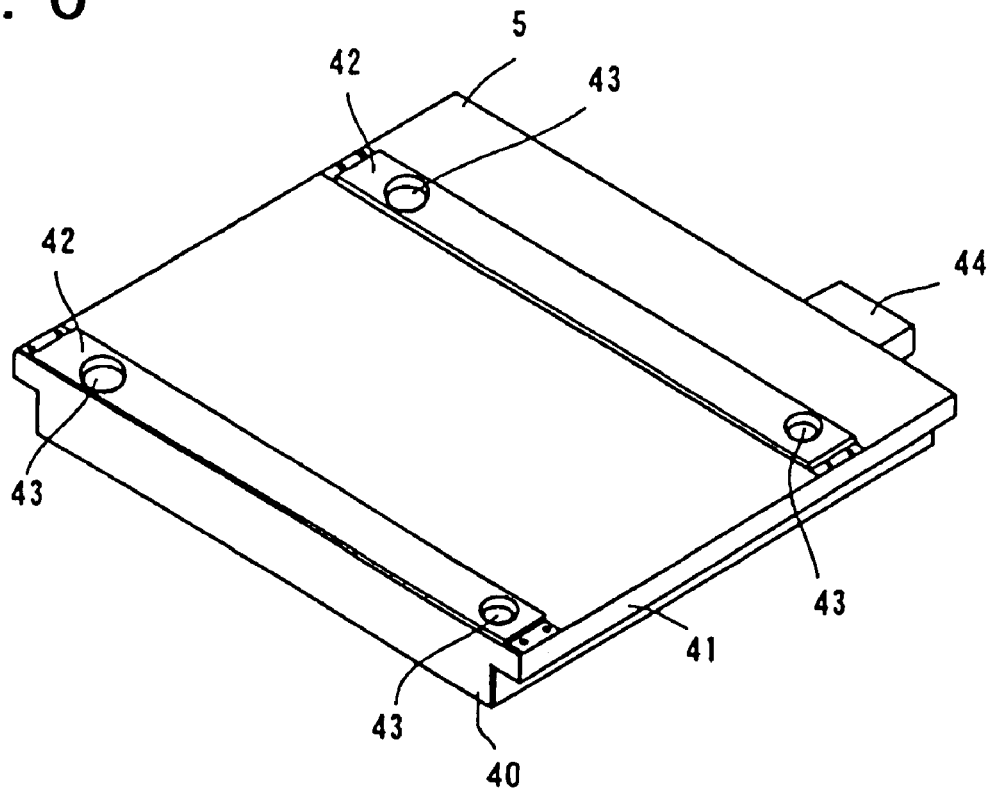
FIG. 6 is a schematic perspective view of a control unit of the second embodiment.

FIG. 5 shows a second embodiment of the present invention. In the second embodiment, the supporting table 3 consists of the supporting part 19, the supporting columns 20, and the rear frame 23. The supporting table 3 does not have the space 22 as shown in FIG. 3, and the entire rear side is formed as the rear frame 23. The image reading apparatus 2, the image recording apparatus 4, and the control unit 5 are disposed on the supporting part 19, and the image reading apparatus 2 is disposed on the supporting part 19 via the control unit 5. The image reading apparatus 2 and the image recording apparatus 4 are as described in the first embodiment. As shown in FIG. 6, in the control unit 5, a device placing part 41 is provided above an approximately rectangular parallepiped chassis 40 in which the control board or the like is provided inside. Two rectangular positioning members 42 are fixed in parallel with one another on an upper surface of the device placing part 41. Concave parts 43 are formed on the positioning members 42 to engage legs of the device respectively. A connector 44 is protruding laterally from one side of the chassis 40 to be electrically connected to another unit. As described above, by providing the control unit 5 as a part of the supporting part 19 to a lower surface of the image reading apparatus 2, installation space can be reduced, and the image forming device can be downsized. In the second embodiment, according to where the image forming device is installed, an ordinary desk can be used for the supporting table 3.

Figure 7:
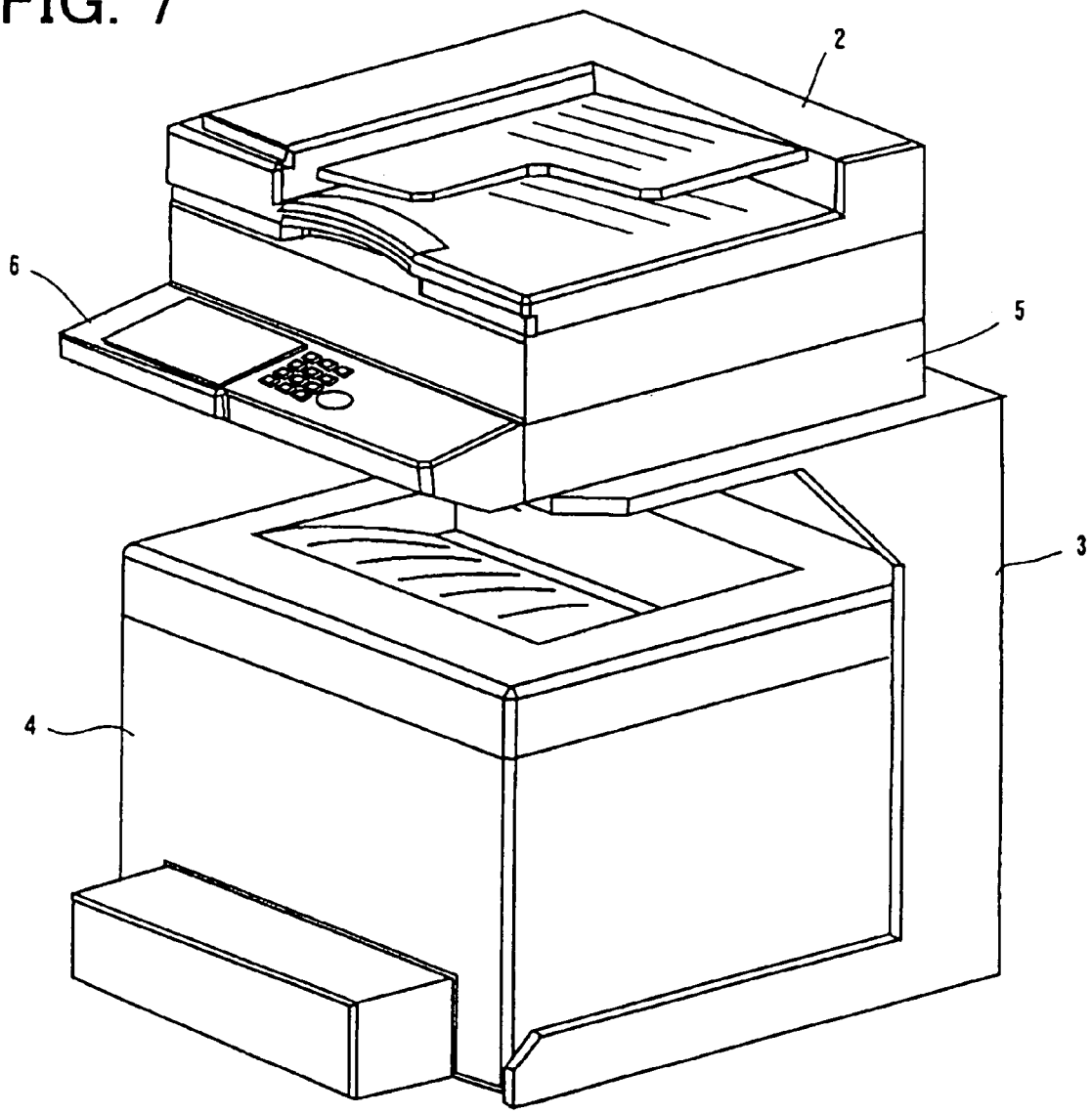
FIG. 7 is a schematic perspective view of an image forming device according to a third embodiment of the present invention.

FIG. 7 shows a third embodiment. In the third embodiment, the image reading apparatus 2 is provided on the upper surface of the supporting table 3 shown in FIG. 1 via the control unit 5. The image recording apparatus 4 is provided in the supporting table 3. The control unit 5 also includes the chassis 40 as in the second embodiment, and the operation panel 6 is detachably attached to the front side of the control unit 5. The operation panel 6 is connected directly to a connector provided in the control unit 5 and attached to the control unit 5. The operation panel 6 can be removed easily. An operation key is arranged on the operation panel 6 in accordance with the function customized according to customer needs, for example, a copy function only or both a copy function and a facsimile function. The operation panel 6 can be attached to the control unit 5 according to each function.

In the above-described embodiments, the image recording apparatus has a cover which can be opened upward. However, the present invention is not limited to this example, and the image recording apparatus can have a cover which can be opened sideward, frontward, or rearward. The image forming device of the present invention can be provided according to various types of image recording apparatus.

This application claims priority under 35 USC 119 of Japanese Patent Application No. 2003-338629 filed on Sep. 29, 2003 with the Japanese Patent Office (JPO), the entire disclosure of which is incorporated herein by reference. The Japanese Patent Application No. 2003-338629 claims internal priority of Japanese Patent Application No. 2002-334185 filed with the JPO on Nov. 11, 2002.

What is claimed is:

1. An image forming device comprising:

an image reading apparatus which reads an original document;

an image recording apparatus which records onto paper, image information read by the image reading apparatus;

a control unit which has a control board for controlling the image reading apparatus and the image recording apparatus; and a supporting table;

wherein the control unit is attached as a part of the supporting table; and wherein the control unit is attached as a reinforcing part which is provided on a rear side of the supporting table.

2. An image forming device comprising:

an image reading apparatus which reads an original document;

an image recording apparatus which records onto paper, image information read by the image reading apparatus;

a control unit which has a control board for controlling the image reading apparatus and the image recording apparatus; and a supporting table;

wherein the control unit is attached as a part of the supporting table; and wherein the control unit is attached as a supporting part which is provided on an upper surface of the supporting table.

3. The image forming device according to claim 2, wherein the control unit includes an operation panel.

4. The image forming device according to claim 3, wherein the operation panel is detachably attached to the control unit.

5. The image forming device according to any one of claims 1 through 4, wherein the image reading apparatus is disposed on the supporting table, and the image recording apparatus is disposed in the supporting table.

6. The image forming device according to any one of claims 1 through 4, wherein the image reading apparatus and the image recording apparatus are disposed on the supporting table.

7. The image forming device according to any one of claims 1 through 4, wherein a cover, which can be opened upward, is provided on an upper part of the image recording apparatus.

* * * * *